United States Patent [19]

Richmond, Jr.

[11] 4,003,044

[45] Jan. 11, 1977

[54] ALARM DEVICE HAVING AN OSCILLATOR

[75] Inventor: William O. Richmond, Jr., Lexington, Ky.

[73] Assignee: Wolsk Associates, Ltd., Lexington, Ky.

[22] Filed: Sept. 30, 1974

[21] Appl. No.: 510,376

[52] U.S. Cl. ..... 340/253 C; 62/125; 331/65; 340/248 B; 340/384 E

[51] Int. Cl.[2] ..... G08B 21/00

[58] Field of Search ..... 340/248, 249, 253, 384 E; 331/64, 65, 111; 307/301, 252 F; 62/125, 129; 236/94; 165/11

[56] References Cited

UNITED STATES PATENTS

| | | | |
|---|---|---|---|
| 3,189,788 | 6/1965 | Cady | 340/253 C X |
| 3,202,937 | 8/1965 | Anderson | 307/301 X |
| 3,748,656 | 7/1973 | Gray et al. | 340/248 A X |
| 3,786,342 | 1/1974 | Molyneux | 340/249 X |
| 3,811,122 | 5/1974 | Raber et al. | 340/249 |
| 3,863,128 | 1/1975 | Wilwerding | 307/252 F X |

OTHER PUBLICATIONS

Electronic Design; p. 122; Dec. 6, 1967 "Voltage to Frequency Converter Built with One UJT Oscillator."
Radio-Electronics; pp. 50–52; Oct. 1970; "How to Putter with the PUT."

*Primary Examiner*—John W. Caldwell
*Assistant Examiner*—Daniel Myer
*Attorney, Agent, or Firm*—Frank C. Leach, Jr.

[57] ABSTRACT

Whenever power fails, an audio signal is produced by an oscillator, which includes a pair of transistors of opposite conductivity having the collector of each connected to the base of the other and is maintained in an off condition as long as the power is on. When the oscillator is turned on, a rapidly changing surge of current is supplied from a battery, which has a capacitor in parallel therewith, to an audio producing device in the discharge path of the oscillator. This surge of current is produced through utilizing a Zener diode between the battery and one of the two transistors of the oscillator. The parallel combination of a resistor and a capacitor is disposed between the Zener diode and the transistors of the oscillator. A resistor also is disposed between the emitter of the transistor initially turned on and a capacitor, which is charged to a potential to turn on the transistor. This resistor is of substantially lower impedance than a resistor between the capacitor and the battery. This arrangement increases the power at least two orders of magnitude.

19 Claims, 13 Drawing Figures

ALARM DEVICE HAVING AN OSCILLATOR

Figure 1:
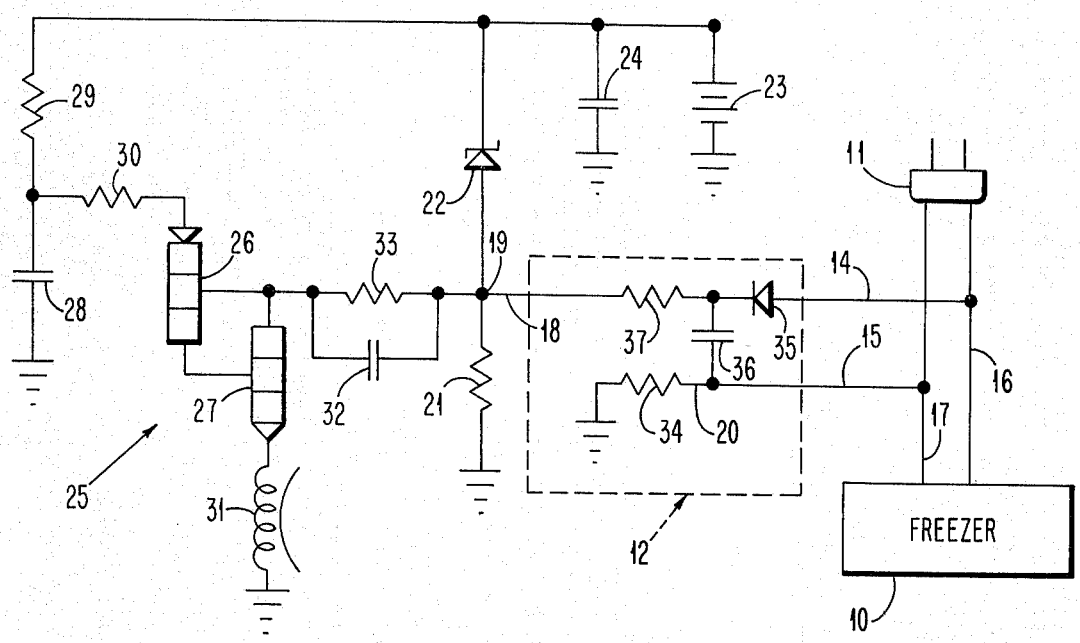

A home food freezer usually contains a large quantity of food. The freezer is normally disposed in an area of the home in which there is usually not much traffic. Furthermore, because a home freezer normally stores relatively expensive foods such as meat, the freezer is not necessarily used every day. In fact, meat may be removed only once a week, for example, for storage in the freezer compartment of a household refrigerator.

Therefore, if the power to the freezer is interrupted when the remainder of the home does not have the power interrupted because of the plug, for example, becoming accidentally disconnected in some manner or due to a fuse blowing, for example, because of a momentary overload in the circuit having the freezer, the failure of the freezer may not be noted for a period of time during which food could become so thawed that it would be of no use. This would result in a substantial economic loss.

Since the power to the freezer can fail when no one is at home, it is necessary for the alarm device to be capable of operating for a relatively long period of time such as seventy-two hours, for example. Thus, if the power to the freezer should fail, the alarm device must be capable of providing a signal for the relatively long period of time.

One previously suggested warning device is shown and described in U.S. Pat. No. 3,022,498 to Alcott. The warning device of the aforesaid Alcott patent relies upon a pair of capacitors to supply power to an audio signal producing device to produce the alarm. This device does not have sufficient available energy to cause the alarm to last for a sufficient period of time if no one is in the home when the power fails.

Another device for producing an alarm signal when power is disconnected from a device, which is a medical electronic instrument, is shown in U.S. Pat. No. 3,678,491 to Day. In the aforesaid Day patent, interruption of power causes a capacitor to continuously discharge through an alarm to produce the signal. A battery can be employed instead of the capacitor in the aforesaid Day patent.

The alarm device of the aforesaid Day patent is limited in its use because the capacitor discharges after a relatively short period of time to stop supply of current to the alarm or the battery, if used, ceases to supply current after a relatively short period of time to the alarm because of the continuous flow of current through the alarm. The device of the aforesaid Day patent is contemplated for use where immediate notification of the turn off of the power is necessary, and there is continuous monitoring of the signal. Thus, the alarm device of the aforesaid Day patent could not be readily utilized where it is desired to have a signal produced for a relatively long period of time as is required for a food freezer, for example.

In U.S. Pat. No. 3,686,666 to Shuey, there is shown an interrupted pulsing circuit for audible signaling. The circuit of the aforesaid Shuey patent uses a pair of oscillators having different frequencies responsive to a logic control signal.

The circuit of the aforesaid Shuey patent is contemplated for use where a low frequency unobstrusive sound is desired. Thus, the circuit of the aforesaid Shuey patent will not produce the desired high level noise signal necessary when used with a home food freezer, for example, to indicate when power is not supplied thereto.

The alarm device of the present invention satisfactorily solves the problems of producing signals capable of being heard at a substantial distance from the freezer and for operating over a relatively long period of time. The present invention is capable of providing a signal for 72 hours with the use of a relatively small battery as the source of power.

The present invention employs a unique oscillator circuit in which the power supplied to the speaker is at least two orders of magnitude greater than that previously available from similar types of oscillators. Thus, this increased power provides a relatively large signal from a relatively small battery.

The alarm device of the present invention is arranged so that the oscillator circuit is inactivated as long as power is supplied to the food freezer. The signal for inactivating the oscillator also causes continuous charging of the battery to insure that the battery is at full power whenever the power to the food freezer fails.

An object of this invention is to provide an alarm device capable of operating for a relatively long period of time from a battery.

Another object of this invention is to provide an oscillator having increased power.

Still another object of this invention is to provide a device for detecting when power is no longer supplied.

Other objects of this invention will be readily perceived from the following description, claims, and drawing.

This invention relates to an oscillator circuit comprising charge storage means, a source of power, and first impedance means connecting the source of power to the charge storage means. The circuit has means responsive to the voltage of the charge storage means reaching a predetermined voltage to provide a discharge path for the charge storage means when the voltage of the charge storage means reaches the predetermined voltage. Means is connected to the responsive means and to the source of power to provide current from the source of power to a load when the responsive means provides the discharge path. The connected means includes low impedance means having a substantially fixed voltage drop irrespective of the magnitude of the current flowing therethrough to supply a relatively high surge of current from the source of power to the load when the responsive means provides the discharge path.

This invention also relates to a device for providing an alarm when power in a circuit fails. The device includes supply means to supply a substantially constant DC voltage when the power in the circuit is on and an oscillator, which is connected by means to the supply means so that the substantially constant DC voltage from the supply means is supplied to the oscillator to inactivate the oscillator as long as the power in the circuit is on. The device also has a source of power, which is separate from the supply means for the oscillator, means to produce a pulsating alarm signal when the oscillator oscillates in response to current flow from the source of power when the oscillator is on, and means to cause a relatively high surge of current to flow through the producing means when the oscillator is on.

The attached drawing illustrates a preferred embodiment of the invention, in which:

FIG. 1 is a schematic circuit diagram of the alarm device of the present invention including the unique oscillator;

FIGS. 2A, 2B, 2C, and 2D show the shape of voltage pulses produced across an impedance of the alarm device of the present invention under certain conditions;

FIGS. 3A, 3B, 3C, and 3D show the shape of voltage pulses produced across the impedance of the alarm device of the present invention under other conditions; and FIGS. 4A, 4B, 4C, and 4D show the shape of voltage pulses produced across the impedance of the alarm device of the present invention under further conditions.

Referring to the drawing and particularly FIG. 1, there is shown a food freezer 10 connected by a plug 11 to a source of power. A rectifier circuit 12, which produces a DC current from the AC current supplied through the plug 11 to the food freezer 10, is connected through lines 14 and 15 to lines 16 and 17, which connect the plug 11 to the food freezer 10.

The rectifier circuit 12 is connected by a line 18 to a node 19. The rectifier circuit 12 also has a line 20 connected to ground.

The node 19 is connected through a resistor 21, which is a relatively high impedance, to ground and through a Zener diode 22 to a battery 23. Accordingly, the DC current from the rectifier circuit 12 continuously charges the battery 23 through the Zener diode 22.

The battery 23 has a capacitor 24 in parallel therewith to enable the current for an oscillator 25 to be supplied from the capacitor 24 to the oscillator 25 rather than the battery 23 during oscillation of the oscillator 25. This is to insure that a peak current, which is supplied to the oscillator 25 during oscillation, is as high as possible since the battery 23 could be of relatively high impedance and reduce this current.

The oscillator 25 includes a PNP transistor 26 and an NPN transistor 27 with each having its collector connected to the base of the other. The transistor 26 has its emitter connected between a capacitor 28 and a resistor 29, which is connected to the battery 23 and the capacitor 24, through a resistor 30. The resistor 30 has an impedance substantially smaller than the impedance of the resistor 29 with the impedance of the resistor 30 preferably being less than 10% of the impedance of the resistor 29.

The capacitor 28 is charged through the resistor 29 from the battery 23 when the oscillator 25 is turned off. When the potential on the capacitor 28 exceeds that on the base of the transistor 26 by a predetermined amount, the transistor 26 conducts. As a result of current flow through the transistor 26 to the base of the transistor 27, the transistor 27 also turns on.

The transistor 27 has its emitter connected to a coil 31 of a speaker, which produces an audio signal whenever the oscillator 25 is turned on, to provide a discharge path for the charge stored in the capacitor 28. When the oscillator 25 is turned on, current flows from the capacitor 28 and the battery 23 in conjunction with the capacitor 24 through the transistors 26 and 27 to the coil 31. The current flow is through the emitter, base, and collector of the transistor 26 and then through the base and emitter of the transistor 27.

At the same time, a relatively high surge of current is supplied to the collector of the transistor 27 from the capacitor 24 through the Zener diode 22 and a capacitor 32, which is disposed between the node 19 and the junction of the collector of the transistor 27 and the base of the transistor 26. A resistor 33 is disposed in parallel with the capacitor 32.

At the time that the oscillator 25 turns on due to the voltage on the capacitor 28 exceeding that at the base of the transistor 26 by a predetermined amount, the capacitor 24 supplies a high peak current through the Zener diode 22 and the capacitor 32 to charge the capacitor 32. This charging of the capacitor 32 produces the surge of current through the capacitor 32, which has a relatively low impedance to the changing current in comparison with the impedance of the resistor 33, so that the coil 31 receives the increased surge of current for a short period of time. The impedance of the capacitor 32 increases as it becomes charged.

As the capacitor 32 charges, the potential at the base of the transistor 26 rises while the voltage on the capacitor 28 falls due to the discharge path of the capacitor 28 through the transistors 26 and 27. Thus, the oscillator 25 turns off shortly after the capacitor 32 becomes charged.

As soon as the oscillator 25 turns off, the capacitor 32 discharges from its plate, which is closest to the node 19, through the resistor 33 to its plate, which is closest to the transistors 26 and 27. This is a short period of time since the potentials at the ends of the resistor 33 become equal to stop the discharge of the capacitor 32.

At the time that the oscillator 25 is turned off, the capacitor 24 also is charged from the battery 23 in a very short period of time of less than one millisecond. Thus, the capacitor 24 is again ready to supply a high peak current through the capacitor 32 to the coil 31 when the oscillator 25 again turns on.

The Zener diode 22 provides a very low impedance to the current flow from the capacitor 24 through the capacitor 32 when the oscillator 25 is turned on. The Zener diode 22 also insures that a constant voltage is always applied at the node 19 whenever there is no current from the rectifier circuit 12.

By making the impedance of the resistor 21 relatively large, substantially all of the current from the capacitor 24 flows through the capacitor 32 when the oscillator 25 is turned on. When the oscillator 25 is turned off, the high impedance of the resistor 21 insures that only a very small current flows from the battery 23 so that the battery 23 is not drained. When the oscillator 25 is turned on, the relatively low impedance of the capacitor 32 to the changing current from the capacitor 24 in comparison with the impedance of the resistor 21 results in substantially all of the current flowing through the coil 31.

The resistor 21 insures that the Zener diode 22 is in continuous breakdown as long as there is no current flowing from the rectifier circuit 12 to the node 19. When current is flowing from the rectifier circuit 12, the Zener diode 22 is forward biased to allow charging of the battery 23 from the rectifier circuit 12.

The voltage from the rectifier circuit 12 must be equal to or greater than the voltage of the battery 23. This insures that the battery 23 is maintained at its desired potential and that the transistor 26 cannot conduct since the potential on the emitter of the transistor 26 from the capacitor 28 cannot become greater than the voltage on the base of the transistor 26 from the rectifier circuit 12.

Considering the operation of the present invention, the rectifier circuit 12 supplies a sufficient potential to the node 19, when there is potential on the lines 16 and 17 to the freezer 10, to maintain the oscillator 25 in its off condition and to charge the battery 23 to its maximum potential. Thus, with the oscillator 25 prevented from oscillating, the coil 31 does not receive any current to produce an alarm signal.

However, as soon as there is no potential on the lines 16 and 17 indicate that power to the freezer 10 has failed so that the rectifier circuit 12 does not supply any power to the node 19, the oscillator 25 starts to oscillate. The transistor 26 turns on because of the potential on the capacitor 28 exceeding the voltage at the base of the transistor 26. As a result, the transistor 27 also turns on to provide a discharge path for the capacitor 28 through the resistor 30, the emitter, base, and collector of the transistor 26, the base and emitter of the transistor 27, and the coil 31 to ground. At the same time, current flows from the capacitor 24 through the Zener diode 22 and the capacitor 32 to the collector of the transistor 27 from which it flows through the base and emitter of the transistor 27, which is turned on, to the coil 31. This peak current from the capacitor 24 exists for a short period of time until the capacitor 32 is charged sufficiently to stop current flow therethrough.

After the capacitor 32 is charged sufficiently to stop current flow therethrough, the high impedance of the resistor 33 in comparison with the low impedance of the capacitor 32 during the high rate of change of current from the capacitor 24 results in the potential at the base of the transistor 26 increasing as the voltage on the capacitor 28 decreases due to its discharging so that the voltage at the emitter of the transistor 26 is not sufficiently greater than the potential at the base of the transistor 26 to maintain the transistor 26 conducting whereby the oscillator 25 turns off. When this occurs, the capacitor 24 is again charged to the potential of the battery 23, and the capacitor 32 discharges through the resistor 33 until the potential of the capacitor 32 is that at the node 19.

With the oscillator 25 turned off, the capacitor 28 is again charged from the battery 23 through the resistor 29 until the oscillator 25 is again turned on because of the potential on the capacitor 28 sufficiently exceeding that at the base of the transistor 26 to render the transistor 26 conductive. Thus, the oscillator 25 turns on and off to supply a pulsating current to the coil 31 to produce the alarm signal from the speaker having the coil 31. The increased power from the current flowing through the Zener diode and the capacitor 32 enables the audio signal produced by the coil 31 to be of sufficient magnitude to be heard throughout a house, for example.

The rectifier circuit 12 includes a resistor 34 in the line 20 to connect the rectifier circuit 12 to ground. The rectifier circuit 12 also includes a diode 35 and a capacitor 36 to function as a half wave rectifier. A resistor 37 is connected at the junction of the diode 35 and the capacitor 36 and is connected to the node 19.

The ratio of the sum of the impedances of the resistors 34 and 37 to the impedance of the resistor 21 must be such that the voltage at the node 19 will be that for which the components are rated. Thus, if the battery 23 should be removed, no damage will result to any of the components through selecting this ratio of the sum of the impedances of the resistors 34 and 37 to the impedance of the resistor 21.

An example of the parameters of the circuit of FIG. 1 is as follows:

| | |
|---|---|
| RESISTORS IN OHMS | |
| 21 | 100K |
| 29 | 18K |
| 30 | 820 |
| 33 | 56 |
| 34 | 330K |
| 37 | 330K |
| CAPACITORS IN MICROFARADS | |
| 24 | 4.7 |
| 28 | 0.033 |
| 32 | 3.3 |
| 36 | 0.27 |
| COIL IN OHMS | |
| 31 | 8 |

TRANSISTORS

The transistor 26 is 2N3638A, and the transistor 27 is 2N3643.

BATTERY

The battery 23 is a 9 volt battery.

ZENER DIODE

The Zener diode 22 breaks down at 3.6 volts.

The use of the Zener diode 22 enables a relatively large current to be supplied to the coil 31 of the speaker since the Zener diode 22 has a very low dynamic impedance. Thus, the Zener diode 22 has a substantially constant impedance irrespective of the magnitude of the current flowing therethrough from the battery 23 and the capacitor 24.

The supply of the relatively large current to the coil 31 produces a relatively large quantity of power if the on time of the oscillator 25 is lengthened. The on time of the oscillator 25 can be lengthened by the addition of the resistor 33. Through utilizing the capacitor 32 in parallel therewith, the relatively large impedance of the resistor 33 is effectively bypassed during at least the first part of the on period of the oscillator 25 so that the relatively high current can flow to the coil 31.

However, the length of the on time period of the oscillator 25 is preferably controlled through utilization of the resistor 30. That is, the oscillator 25 could function satisfactorily without the resistor 30. However, through having the impedance of the resistor 30 substantially larger than the impedance of the coil 31 such as over 20 times as great, for example, and substantially smaller than the impedance of the resistor 29 such as less than 10% , for example, any change in the impedance of the coil 31 does not have any significant effect on the length of the on time of the oscillator 25. Thus, the use of the resistor 30 enables the circuit to be employed with the coil 31 having different impedances such as 8 ohms, 16 ohms, and 32 ohms, for example.

Without the resistor 30, the impedance of the coil 31 has an effect on the length of the time that the oscillator 25 is on so that the impedance of the capacitor 32 and the resistor 33 must be designed, if the resistor 30 is not utilized, in conjunction with the impedance of the coil 31. Thus, while the circuit of the present invention can be employed without the resistor 30 and only with the capacitor 32 and the resistor 33, the impedances of the capacitor 32 and the resistor 33 would have to be selected in accordance with the magnitude of the impedance of the coil 31. By the use of the resistor 30, this matching of the impedances of the capacitor 32 and the resistor 33 with the impedance of the coil 31 can be effectively eliminated.

Furthermore, the oscillator 25 could be effectively utilized without the capacitor 32 and the resistor 33. In this arrangement, the desired increase in the length of the on time period of the oscillator 25 is still obtained because the time constant of the oscillator 25 is the product of the capacitance of the capacitor 28 and the resistance of the resistor 30. However, the shape of the pulse across the coil 31 does not produce as much power as when using the capacitor 32 and the resistor 33. Thus, the use of the resistor 30 and the parallel combination of the capacitor 32 and the resistor 33 not only gives the most desired length of the on time period of the oscillator 25 but gives the most desired pulse shape for producing power.

Tests have been run on a test circuit like that shown in FIG. 1 without the plug 11 connected to a source of power so that the oscillator 25 could oscillate. In one group of tests, both the capacitor 32 and the resistor 33 were omitted; in another group of tests, the capacitor 32 was omitted; and in still another group of tests, both the capacitor 32 and the resistor 33 were used.

In each group of tests, the resistance of the resistor 30 was set at 0, 10, 100, and 1,000 ohms. Thus, the resistor 30 was omitted when set at 0 ohms. The other parameters of the test circuit were the same as those previously mentioned as an example of the parameters of the circuit of FIG. 1 except that the resistor 29 was 15K ohms, the coil 31 was replaced by a resistor having an impedance of 8.2 ohms, the capacitor 32 had an impedance of 10 microfarads, and the resistor 33 had an impedance of 27 ohms.

The following results were obtained when the capacitor 32 and the resistor 33 were omitted from the circuit:

TABLE I

| (1) | (2) | (3) | (4) | (5) | (6) | (7) |
|---|---|---|---|---|---|---|
| 0 | 2 | 244 | 0.5 | 0.25 | 0.125 | 0.28 |
| 10 | 3 | 366 | 1.1 | 0.55 | 0.55 | 1.3 |
| 100 | 8 | 976 | 7.8 | 3.9 | 7.8 | 18 |
| 1000 | 9 | 1100 | 9.9 | 6.5 | 32.5 | 73. |

Figure 2A:
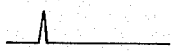
Figure 2B:
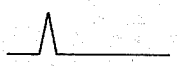
Figure 2C:
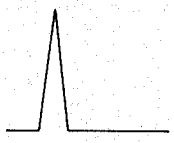
Figure 2D:
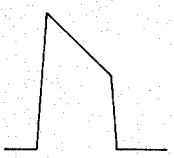

The voltage pulse produced across the impedance of 8.2 ohms with the circuit without the capacitor 32 and the resistor 33 and the resistor 30 omitted (0 ohms) is shown in FIG. 2A. With the impedance of the resistor 30 being 10 ohms, the voltage pulse across the impedance of 8.2 ohms is shown in FIG. 2B. FIG. 2C shows the voltage pulse across the impedance of 8.2 ohms with the resistance of the resistor 30 being 100 ohms while FIG. 2D shows the voltage pulse across the impedance of 8.2 ohms with the resistance of the resistor 30 being 1000 ohms.

The following results were obtained when the circuit did not have the capacitor 32:

TABLE II

| (1) | (2) | (3) | (4) | (5) | (6) | (7) |
|---|---|---|---|---|---|---|
| 0 | 3 | 366 | 1.1 | 0.6 | 0.3 | 0.6 |
| 10 | 5 | 609 | 3.04 | 1.5 | 1.5 | 3.5 |
| 100 | 8 | 976 | 7.8 | 4 | 8 | 18 |
| 1000 | 7 | 854 | 6 | 3.3 | 23.1 | 52.5. |

Figure 3A:
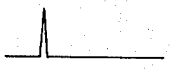
Figure 3B:
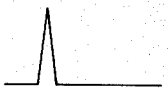
Figure 3C:
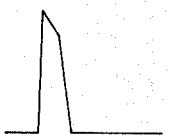
Figure 3D:
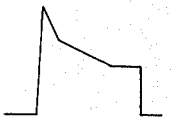

The voltage pulse produced across the impedance of 8.2 ohms with the circuit without the capacitor 32 and the resistor 30 omitted (0 ohms) is shown in FIG. 3A. With the impedance of the resistor 30 being 10 ohms, the voltage pulse across the impedance of 8.2 ohms is shown in FIG. 3B. FIG. 3C shows the voltage pulse across the impedance of 8.2 ohms with the resistance of the resistor 30 being 100 ohms while FIG. 3D shows the voltage pulse across the impedance of 8.2 ohms with the resistance of the resistor 30 being 1000 ohms.

The following results were obtained when the circuit had both the resistor 33 and the capacitor 32:

TABLE III

| (1) | (2) | (3) | (4) | (5) | (6) | (7) |
|---|---|---|---|---|---|---|
| 0 | 2 | 244 | 0.5 | 0.25 | 0.125 | 0.3 |
| 10 | 4 | 488 | 2 | 1 | 1 | 2.3 |
| 100 | 9 | 1100 | 9.9 | 5 | 10 | 23 |
| 1000 | 9 | 1100 | 9.9 | 5.5 | 41.25 | 94. |

Figure 4A:
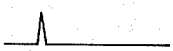
Figure 4B:
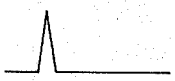
Figure 4C:
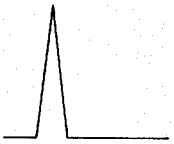

The voltage pulse produced across the impedance of 8.2 ohms with the circuit having both the capacitor 32 and the resistor 33 and the resistor 30 omitted (0 ohms) is shown in FIG. 4A. With the impedance of the resistor 30 being 10 ohms, the voltage pulse across the impedance of 8.2 ohms is shown in FIG. 4B. FIG. 4C shows the voltage pulse across the impedance of 8.2 ohms with the resistance of the resistor 30 being 100 ohms while FIG. 4D shows the voltage pulse across the impedance of 8.2 ohms with the resistance of the resistor 30 being 1000 ohms.

Figure 4D:
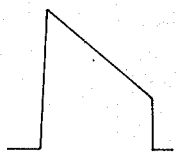

From the foregoing tests, the most desired pulse shape for highest power is obtained when using the capacitor 32 and the resistor 33 and the resistance of the resistor 30 is substantially large in comparison with the impedance of the resistor replacing the coil 31 as is shown by the voltage pulse shape in FIG. 4D. This produces the greatest power across the coil 31.

Without the capacitor 32 but with the resistor 33, FIG. 3D shows the pulse shape that produces the least power of the three configurations with the resistor 30 having a resistance of 1000 ohms. This confirms the prior statement that the capacitor 32 enables the current to effectively bypass the impedance of the resistor 33.

The effect of the absence of the resistor 30 is shown by the voltage pulses produced in FIGS. 2A, 3A, and 4A. Thus, it is necessary for the impedance of the resistor 30 to be at least an order of magnitude greater than the impedance of the coil 31, as indicated by FIGS. 2C, 3C, and 4C, to produce a significant amount of power.

Of course, as previously mentioned, careful matching of the impedances of the capacitor 32 and the resistor 33 with the impedance of the coil 31 would produce a significantly different amount of power without the resistor 30. However, the tests, which produced the voltage pulses in FIGS. 2A, 2B, 2C, 2D, 3A, 3B, 3C, 3D, 4A, 4B, 4C, and 4D with each having the same units of voltage along its abscissa and each having the same units of time along its ordinate, have been employed to show the relationship of the various magnitudes of the impedances of the resistor 30 without any requirement for matching the impedances of the capacitor 32 and the resistor 33 to the impedance of the coil 31.

While the present invention has shown and described the transistors 26 and 27 as being the means responsive to the potential of the capacitor 28 to enable current to flow through the coil 31, it should be understood that any other suitable responsive means could be employed. For example, a silicon controlled rectifier, a programmable unijunction transistor, or a silicon controlled switch could be employed as the responsive means.

Additionally, the transistors 26 and 27 could have their conductivities reversed. Of course, this would cause the necessity of reversing the polarity of each of the other bipolar elements of the circuit.

While the present invention has shown and described the coil 31 as being connected to the emitter of the transistor 27. it should be understood that such is not a requisite for the present invention to produce the alarm signal. It is only necessary for the coil 31 to have the relatively high surge of current, which flows through the Zener diode 22, to pass therethrough. Thus, the coil 31 could be connected between the collector of the transistor 27 and the base of the transistor 26 or between the junction of the base of the transistor 26 and the collector of the transistor 27 and the junction of the parallel combination of the capacitor 32 and the resistor 33. The coil 31 also could be positioned between the node 19 and the junction of the capacitor 32 and the resistor 33. The coil 31 also could be disposed between the junction of the capacitor 24 and the battery 23 and the junction of the Zener diode 22 and the resistor 29.

While the present invention has shown and described the Zener diode 22 as forming the low impedance means, it should be understood that any other suitable means could be employed. For example, a parallel relationship of diodes could be employed with one diode providing current flow to the battery 23 and a plurality of diodes providing current flow from the battery 23 to the coil 31. Similarly, when the oscillator 25 is not used with the rectifier circuit 12, it would only be necessary for diodes to be used to allow current flow from the battery 23 and the capacitor 24 to the coil 31.

While the alarm device of the present invention has been shown and described as producing an audio signal from the relatively high surge of current supplied to the coil 31, it should be understood that any type of alarm device could be employed if desired. Thus, for example, a visual signal could be produced through replacing the coil 31 by a suitable load for activating a visual signal.

While the present invention has shown and described the alarm device as being utilized with a food freezer, it should be understood that the alarm device may be employed anywhere it is desired to have an alarm or warning signal indicate that power is no longer supplied. Thus, the alarm device could be employed to indicate when power is no longer supplied to a computer, for example.

While the oscillator 25 of the present invention has been shown and described as producing power for an alarm device, it should be understood that the oscillator 25 is particularly useful whenever a relatively high surge of current is required for a short period of time. Thus, the oscillator 25 of the present invention could be employed as a trigger circuit for a high power silicon controlled rectifier, for example.

An advantage of this invention is that it is relatively inexpensive. Another advantage of this invention is that it provides a relatively loud audio signal. A further advantage of this invention is that the battery, which is the source of power for the oscillator, is continuously charged from the rectifier circuit. Still another advantage of this invention is that an oscillator having an increased on time period is provided.

For purposes of exemplification, a particular embodiment of the invention has been shown and described according to the best present understanding thereof. However, it will be apparent that changes and modifications in the arrangement and construction of the parts thereof may be resorted to without departing from the scope of the invention.

I claim:

1. An oscillator circuit comprising:

charge storage means;

a source of power;

first impedance means connecting said source of power to said charge storage means;

second impedance means and third impedance means connected in series to opposite sides of said source of power, said second impedance means having a lower impedance than said third impedance means;

responsive means connected to said source of power through said second impedance means;

said responsive means being responsive to the voltage of said charge storage means reaching a predetermined voltage greater than a voltage supplied to said responsive means from said source of power through said second impedance means to provide a discharge path for said charge storage means when the voltage of said charge storage means reaches the predetermined voltage;

a resistor connected solely between said responsive means and the junction of said first impedance means and said charge storage means, said resistor having an impedance substantially smaller than the impedance of said first impedance means;

a capacitor and a resistor connected in parallel, one junction of the parallel combination of said capacitor and said resistor being connected to the junction of said second impedance means and said third impedance means and the other junction of the parallel combination of said capacitor and said resistor being connected to said responsive means;

and said source of power supplying a surge of current to a load when said responsive means provides the discharge path, said second impedance means having a substantially fixed voltage drop irrespective of the magnitude of current flowing therethrough to supply the surge of current from said source of power to the load when said responsive means provides the discharge path.

2. The oscillator circuit according to claim 2 in which said resistor connected solely between said responsive means and the junction of said first impedance means and said charge storage means has an impedance less than 10 per cent of the impedance of said first impedance means.

3. The oscillator circuit according to claim 2 in which said second impedance means includes a Zener diode.

4. The oscillator circuit according to claim 1 in which said second impedance means includes a Zener diode.

5. The oscillator circuit according to claim 1 in which said responsive means includes a pair of transistors of opposite conductivity having the collector of each connected to the base of the other, one of said transistors having its emitter connected to said charge storage means through said resistor and its base connected to the other junction of the parallel combination of said capacitor and said resistor, and the other of said transistors having its emitter connected in the discharge path.

6. The oscillator circuit according to claim 5 in which said second impedance means includes a Zener diode.

7. The oscillator circuit according to claim 5 in which said resistor connected solely between said responsive means and the junction of said first impedance means and said charge storage means has an impedance less than ten per cent of the impedance of said first impedance means.

8. The oscillator circuit according to claim 7 in which said second impedance means includes a Zener diode.

9. The oscillator circuit according to claim 5 in which the other of said transistors has its emitter connected to the load.

10. A device for providing an alarm when power in a circuit fails including:

supply means to supply a subtantially constant DC voltage when the power in the circuit is on;

an oscillator;

means connecting said supply means to said oscillator to supply the substantially constant DC voltage from said supply means to said oscillator to inactivate said oscillator as long as the power in the circuit is on;

a source of power, separate from said supply means, for said oscillator, means to produce a pulsating alarm signal when said oscillator oscillates in response to current flow from said source of power when said oscillator is activated;

said oscillator including means to cause a surge of current to flow through said producing means from said source of power when said oscillator is activated and on;

first impedance means and second impedance means connected in series to opposite sides of said source of power, said first impedance means having a lower impedance than said second impedance means;

said first impedance means including means having a substantially fixed voltage drop irrespective of the magnitude of current flowing therethrough from said source of power to form part of said causing means;

a battery as said source of power for said oscillator;

and said supply means being connected to the junction of said first impedance means and said second impedance means so as to be connected to said battery through said first impedance means to continuously charge said battery from said supply means when the power of the circuit is on.

11. The device according to claim 10 in which said oscillator includes:

charge storage means;

third impedance means connecting said battery to said charge storage means;

and responsive means connected to said charge storage means and to the junction of said first impedance means and said second impedance means, said responsive means being responsive to the voltage of said charge storage means reaching a predetermined voltage greater than a voltage from said source of power through said first impedance means when the power fails to provide a discharge path for said charge storage means when the voltage of said charge storage means reaches the predetermined voltage to turn on said oscillator.

12. The device according to claim 11 in which said responsive means includes a pair of transistors of opposite conductivity having the collector of each connected to the base of the other, one of said transistors having its emitter connected to said charge storage means and its base connected to the junction of said first impedance means and said second impedance means, and the other of said transistors having its emitter connected in the discharge path.

13. The device according to claim 12 including a capacitor and a resistor connected in parallel, one junction of the parallel combination of said capacitor and said resistor being connected to the junction of said first impedance means and said second impedance means and the other junction of the parallel combination of said capacitor and said resistor being connected to the base of said one transistor.

14. The device according to claim 13 including a resistor connected solely between the emitter of said one transistor and the junction of said third impedance means and said charge storage means, said resistor having an impedance substantially smaller than the impedance of said third impedance means.

15. The device according to claim 14 in which said first impedance means include a Zener diode.

16. The device according to claim 12 including a resistor connected solely between the emitter of said one transistor and the junction of said first impedance means and said charge storage means, said resistor having an impedance substantially smaller than the impedance of said first impedance means.

17. A device for providing an alarm when power in a circuit fails including:

supply means to supply a substantially constant DC voltage when the power in the circuit is on;

an oscillator;

means connecting said supply means to said oscillator to supply the substantially constant DC voltage from said supply means to said oscillator to inactivate said oscillator as long as the power in the circuit is on;

a source of power, separate from said supply means, for said oscillator;

means to produce a pulsating alarm signal when said oscillator oscillates in response to current flow from said source of power when said oscillator is activated;

said oscillator including means to cause a surge of current to flow through said producing means from said source of power when said oscillator is activated and on;

first impedance means and second impedance means connected in series to opposite sides of said source of power, said first impedance means having a lower impedance than said second impedance means;

said first impedance means including means having a substantially fixed voltage drop irrespective of the magnitude of current flowing therethrough from said source of power to form part of said causing means;

said oscillator including:

charge storage means;

third impedance means connecting said source of power to said charge storage means;

responsive means connected to said charge storage means and to the junction of said first impedance means and said second impedance means, said responsive means being responsive to the voltage of said charge storage means reaching a predetermined voltage greater than a voltage from said source of power through said first impedance means when the power fails to provide a discharge path for said charge storage means when the voltage of said charge storage means reaches the predetermined voltage to turn on said oscillator;

and said responsive means including a pair of transistors of opposite conductivity having the collector of each connected to the base of the other, one of said transistors having its emitter connected to said charge storage means, and the other of said transistors having its emitter connected in the discharge path;

and a capacitor and a resistor connected in parallel, one junction of the parallel combination of said capacitor and said resistor being connected to the junction of said first impedance means and said second impedance means and the other junction of the parallel combination of said capacitor and said resistor being connected to the base of said one transistor.

18. The device according to claim 17 including a resistor connected solely between the emitter of said one transistor and the junction of said third impedance means and said charge storage means, said resistor having an impedance substantially smaller than the impedance of said third impedance means.

19. The device according to claim 18 in which said second impedance means includes a Zener diode.

* * * * *

UNITED STATES PATENT OFFICE

CERTIFICATE OF CORRECTION

Patent No. 4,003,044 Dated January 11, 1977

Inventor(s) William O. Richmond, Jr.

It is certified that error appears in the above-identified patent and that said Letters Patent are hereby corrected as shown below:

Col. 5, line 10, after "17" insert -- to --.

Col. 7, line 45, insert the following as a separate paragraph:

---Column (1) is the resistance of the resistor 30, column (2) is the peak voltage across the impedance of 8.2 ohms in volts, column (3) is the peak current through the impedance of 8.2 ohms in milliamps, column (4) is the peak power produced across the impedance of 8.2 ohms in watts, column (5) is the approximate average watts of power during a pulse, column (6) is the approximate relative average power output per pulse, and column (7) is the actual power in milliwatts during an entire cycle.---

UNITED STATES PATENT OFFICE

CERTIFICATE OF CORRECTION

Patent No. 4,003,044 Dated January 11, 1977

Inventor(s) William O. Richmond, Jr. Page 2 of 2

It is certified that error appears in the above-identified patent and that said Letters Patent are hereby corrected as shown below:

Column 7, line 65, insert the following as a separate sentence:

---The columns for Table II are the same as for Table I.---

Col. 8, line 18, insert the following as a separate sentence:

---The columns for Table III are the same as for Table I.---

Col. 9, line 12, the "period (.)" should be a---comma (,)---

IN THE CLAIMS

Col. 11, line 27, the "comma (,)" should be a---semi-colon (;)--.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*